US012460623B2

(12) United States Patent
Busquets et al.

(10) Patent No.: US 12,460,623 B2
(45) Date of Patent: Nov. 4, 2025

(54) INTEGRATED ELECTRO-HYDRAULIC UNIT

(71) Applicant: Robert Bosch GmbH, Stuttgart (DE)

(72) Inventors: Enrique Busquets, Greer, SC (US); Andreas Guender, Lohr am Main (DE)

(73) Assignee: Robert Bosch GmbH, Stuttgart (DE)

( * ) Notice: Subject to any disclaimer, the term of this patent is extended or adjusted under 35 U.S.C. 154(b) by 110 days.

(21) Appl. No.: 18/475,876

(22) Filed: Sep. 27, 2023

(65) Prior Publication Data

US 2025/0101966 A1 Mar. 27, 2025

(51) Int. Cl.
*F04B 1/20* (2020.01)
*F04B 1/128* (2020.01)
*F04B 17/03* (2006.01)

(52) U.S. Cl.
CPC ..... *F04B 1/20* (2013.01); *F04B 1/128* (2013.01); *F04B 17/03* (2013.01)

(58) Field of Classification Search
CPC .. F04B 1/20; F04B 1/128; F04B 17/03; F04B 1/2078; F04B 1/126; F04B 1/22; F04B 1/2007; F04B 1/2035; F04B 1/2042; F04B 1/2071; F04B 1/2085; F04B 1/324; F04B 1/02; F04B 1/14; F04B 1/141; F04B 1/145; F04B 1/146; F04B 1/2014; F04B 2201/0805; F04B 23/021; F04B 23/06; F04B 23/106; F04B 27/08; F04B 27/0817; F04B 27/0882; F04B 27/0886; F04B 27/0895; F04B 27/1054; F04B 39/1066; F04B 49/08; F04B 53/1047; F04B 53/14; F04B 53/162; F04B 9/02
USPC ..... 417/237
See application file for complete search history.

(56) References Cited

U.S. PATENT DOCUMENTS 1,849,222 A 3/1932 Canton
3,279,216 A * 10/1966 Spaulding, Jr. ..... F16D 3/185 464/154
3,295,457 A * 1/1967 Oram ..... F04B 1/2035 91/488

(Continued)

FOREIGN PATENT DOCUMENTS

CN 102536722 B 9/2014
CN 103437975 B 11/2015

(Continued)

*Primary Examiner* — Mark A Laurenzi
*Assistant Examiner* — Benjamin Doyle
(74) *Attorney, Agent, or Firm* — Michael Best & Friedrich LLP

(57) ABSTRACT

An integrated electro-hydraulic unit including an electric machine having a stator and a rotor. The integrated electro-hydraulic unit includes a hydraulic machine having a shaft configured to rotate around a central axis and a cylinder block coupled to the shaft. The cylinder block includes a plurality of bores receiving a plurality of pistons. The cylinder block is configured to rotate about the central axis to generate reciprocating movement of the plurality of pistons within the plurality of bores. The cylinder block and the shaft are coupled for rotation via a joint that accommodates bending of the shaft while maintaining a parallel orientation of the cylinder block with respect to the central axis. The joint is defined by a barrel-shaped portion of the shaft and a corresponding interior receiving portion of the cylinder block.

19 Claims, 6 Drawing Sheets

(56) References Cited

U.S. PATENT DOCUMENTS

| | | | | |
|---|---|---|---|---|
| 3,522,759 | A * | 8/1970 | Martin | F01B 3/0088 91/507 |
| 4,529,362 | A | 7/1985 | Ichiryu et al. | |
| 4,602,554 | A * | 7/1986 | Wagenseil | F04B 1/2042 91/499 |
| 4,729,717 | A * | 3/1988 | Gupta | F04B 1/22 417/410.1 |
| 4,850,812 | A * | 7/1989 | Voight | F04B 17/03 417/357 |
| 4,922,119 | A * | 5/1990 | Raad | F02N 11/04 290/46 |
| 5,141,402 | A | 8/1992 | Bloomquist et al. | |
| 5,220,225 | A | 6/1993 | Moon, Jr. | |
| 5,224,898 | A * | 7/1993 | Johnson | E21B 17/073 464/83 |
| 5,591,013 | A * | 1/1997 | Kawafune | F04B 1/20 417/271 |
| 6,769,745 | B2 | 8/2004 | Mohr et al. | |
| 7,182,583 | B2 | 2/2007 | Gandrud et al. | |
| 7,794,212 | B2 * | 9/2010 | Hugelman | F04B 1/146 91/506 |
| 8,358,042 | B2 | 1/2013 | Yamada et al. | |
| 9,856,851 | B2 * | 1/2018 | Kato | F03C 1/0652 |
| 10,677,207 | B2 | 6/2020 | Ashton et al. | |
| 11,255,359 | B2 | 2/2022 | Jagoda et al. | |
| 12,031,559 | B1 | 7/2024 | Busquets et al. | |
| 2002/0153768 | A1 | 10/2002 | Mohr et al. | |
| 2005/0175479 | A1 * | 8/2005 | Gandrud | F04B 23/021 417/410.3 |
| 2011/0001370 | A1 | 1/2011 | Yamada et al. | |
| 2013/0177394 | A1 * | 7/2013 | Yamada | F03C 1/0623 415/10 |
| 2013/0315758 | A1 | 11/2013 | Olson | |
| 2013/0327208 | A1 * | 12/2013 | Ohno | F04B 1/2078 91/505 |
| 2017/0016432 | A1 * | 1/2017 | Ishikawa | F04B 1/2078 |
| 2017/0241480 | A1 * | 8/2017 | Parmeter | E21B 43/128 |
| 2020/0063723 | A1 * | 2/2020 | Maekawa | F03C 1/0639 |
| 2025/0012262 | A1 | 1/2025 | Vacca et al. | |

FOREIGN PATENT DOCUMENTS

| | | | |
|---|---|---|---|
| CN | 106089624 | A | 11/2016 |
| CN | 106286195 | A | 1/2017 |
| DE | 19650270 | A1 | 6/1998 |
| DE | 102007032138 | A1 | 1/2009 |
| DE | 102007058858 | A1 | 6/2009 |
| DE | 102011121531 | A1 | 6/2013 |
| EP | 0578390 | A1 | 1/1994 |
| EP | 0611887 | A1 | 8/1994 |
| EP | 0819848 | B1 | 6/2003 |
| EP | 1462647 | A2 | 9/2004 |
| EP | 1536139 | A1 | 6/2005 |
| EP | 1669599 | A1 | 6/2006 |
| WO | 9723733 | A2 | 7/1997 |

* cited by examiner

INTEGRATED ELECTRO-HYDRAULIC UNIT

FIELD OF THE INVENTION

The present disclosure relates to an electric and hydraulic machine. More particularly, the present disclosure relates to an integrated electro-hydraulic unit.

BACKGROUND OF THE INVENTION

The present disclosure relates to an integrated electro-hydraulic unit. As is often the case, integrated electro-hydraulic units include a hydraulic machine and an electric machine. The hydraulic machine is responsible for interacting with a working fluid. The electric machine is responsible for inducing rotation of the hydraulic machine and/or recovering energy from the rotation of the hydraulic machine.

SUMMARY OF THE INVENTION

The present invention provides, in one aspect, an integrated electro-hydraulic unit including an electric machine having a stator and a rotor. The integrated electro-hydraulic unit includes a hydraulic machine having a shaft configured to rotate around a central axis and a cylinder block coupled to the shaft. The cylinder block includes a plurality of bores receiving a plurality of pistons. The cylinder block is configured to rotate about the central axis to generate reciprocating movement of the plurality of pistons within the plurality of bores. The cylinder block and the shaft are coupled for rotation via a joint that accommodates bending of the shaft while maintaining a parallel orientation of the cylinder block with respect to the central axis. The joint is defined by a barrel-shaped portion of the shaft and a corresponding interior receiving portion of the cylinder block.

The present invention provides, in another aspect, an integrated electro-hydraulic unit including an electric machine having a stator and a rotor. The integrated electro-hydraulic unit includes a hydraulic machine having a shaft configured to rotate around a central axis and a cylinder block coupled to the shaft. The cylinder block includes a plurality of bores receiving a plurality of pistons. A swashplate cooperates with the plurality of pistons to generate reciprocating movement of the plurality of pistons within the plurality of bores upon rotation of the cylinder block. The cylinder block and the shaft are coupled via a joint that accommodates bending of the shaft while maintaining a parallel orientation of the cylinder block with respect to the central axis. The plurality of pistons include ball ends movable about the central axis and along a swashplate to define a piston plane parallel to the swashplate. A center point of the joint is located at an intersection of the piston plane and the central axis.

The present invention provides, in another aspect, an integrated electro-hydraulic unit including an electric machine having a stator and a rotor, the rotor including an axial center. The integrated electro-hydraulic unit includes a hydraulic machine having a shaft configured to rotate around a central axis and a cylinder block coupled to the shaft. The cylinder block includes a plurality of pistons within the cylinder block. The cylinder block is configured to rotate about the central axis to generate reciprocating movement of each of the plurality of pistons. The cylinder block and the shaft are coupled via a joint that accommodates bending of the shaft while maintaining a parallel orientation of the cylinder block with respect to the central axis. The joint is defined by a barrel-shaped portion of the shaft and a corresponding interior receiving portion of the cylinder block. A center point of the joint is axially aligned with the axial center of the rotor.

DETAILED DESCRIPTION

Figure 1:
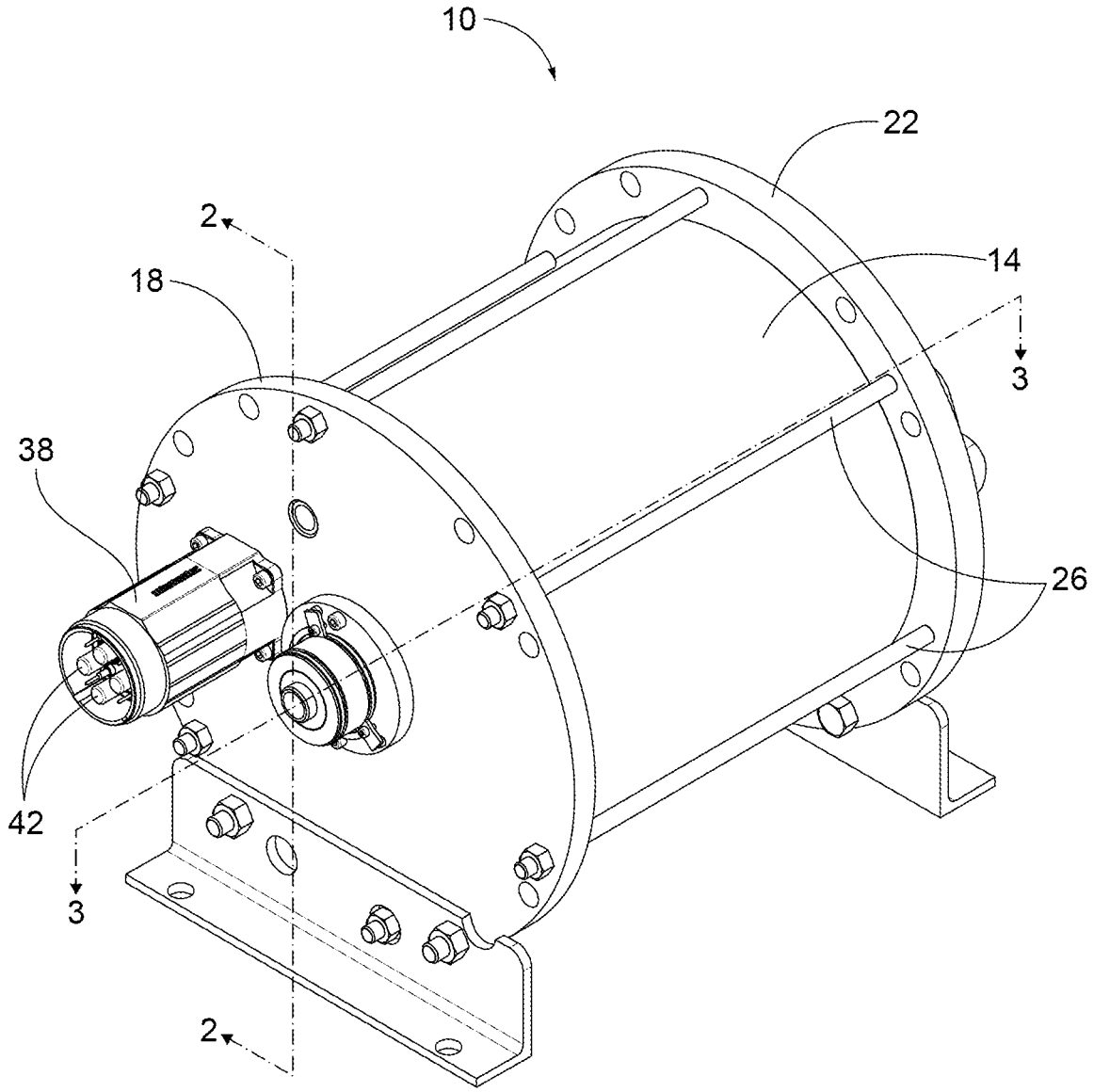
FIG. 1 illustrates a perspective view of an integrated electro-hydraulic unit, according to one embodiment of the present disclosure.
Figure 2:
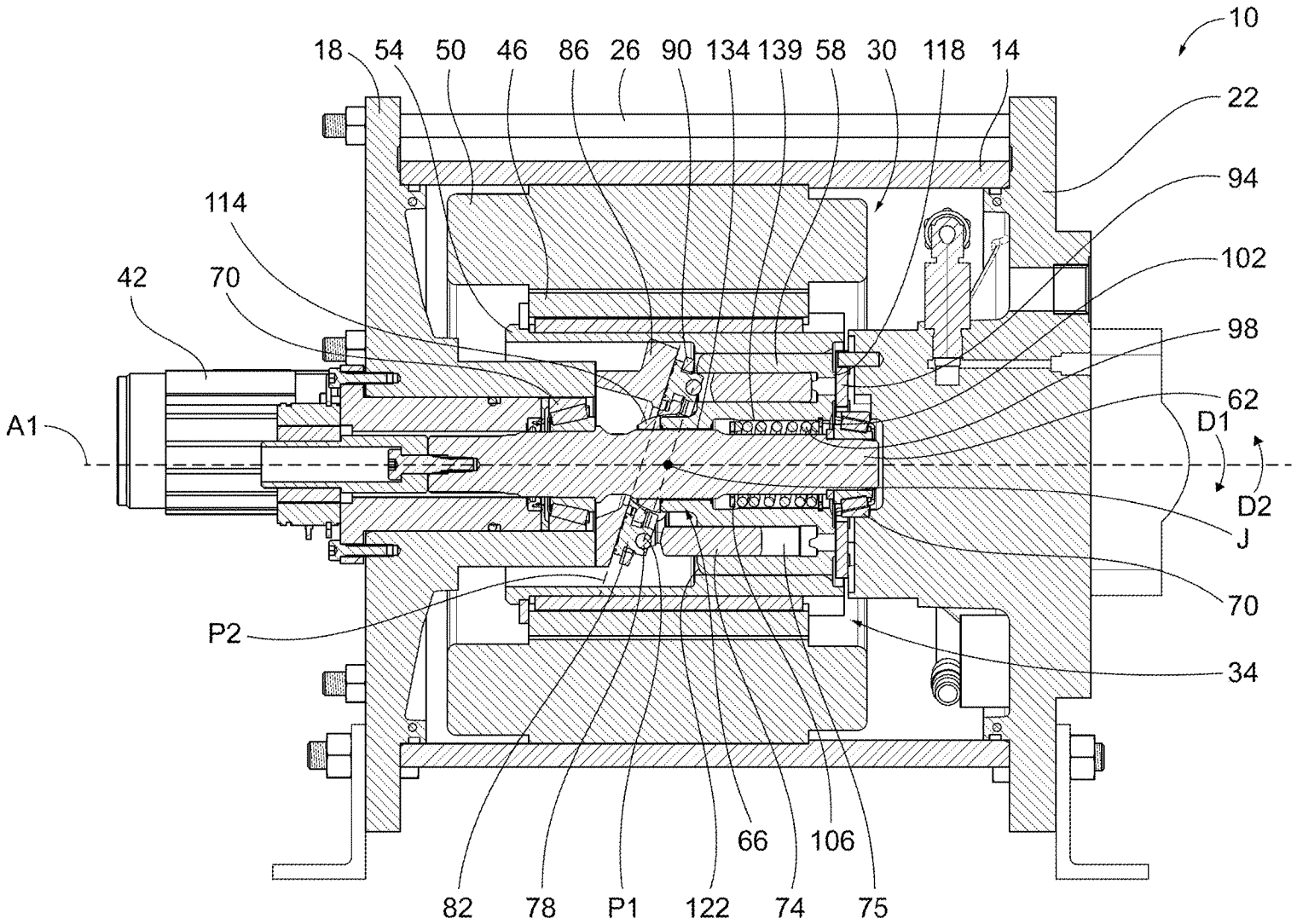
FIG. 2 illustrates a longitudinal cross-section of the integrated electro-hydraulic unit taken along line 2-2 of FIG. 1.

FIG. 1 illustrates an integrated electro-hydraulic unit 10 according to one construction of the present disclosure. The integrated electro-hydraulic unit 10 includes a radial casing 14, a swashplate end case 18, and a porting end case 22. Fasteners 26 extend transverse to the end cases 18, 22 and parallel to a shared rotational axis A1 (FIG. 2). The fasteners 26 secure the swashplate end case 18 and the porting end case 22 to each other with the radial casing 14 therebetween. Thus, the radial casing 14 and the end cases 18, 22 form a singular shared interior cavity for both an electric machine 30 and a hydraulic machine 34 as discussed in further detail below. The swashplate end case 18 includes an electrical interface 38 that accommodates the routing of wires 42 to the electric machine 30. The wires 42 are used to provide power to the electric machine 30.

Figure 3:
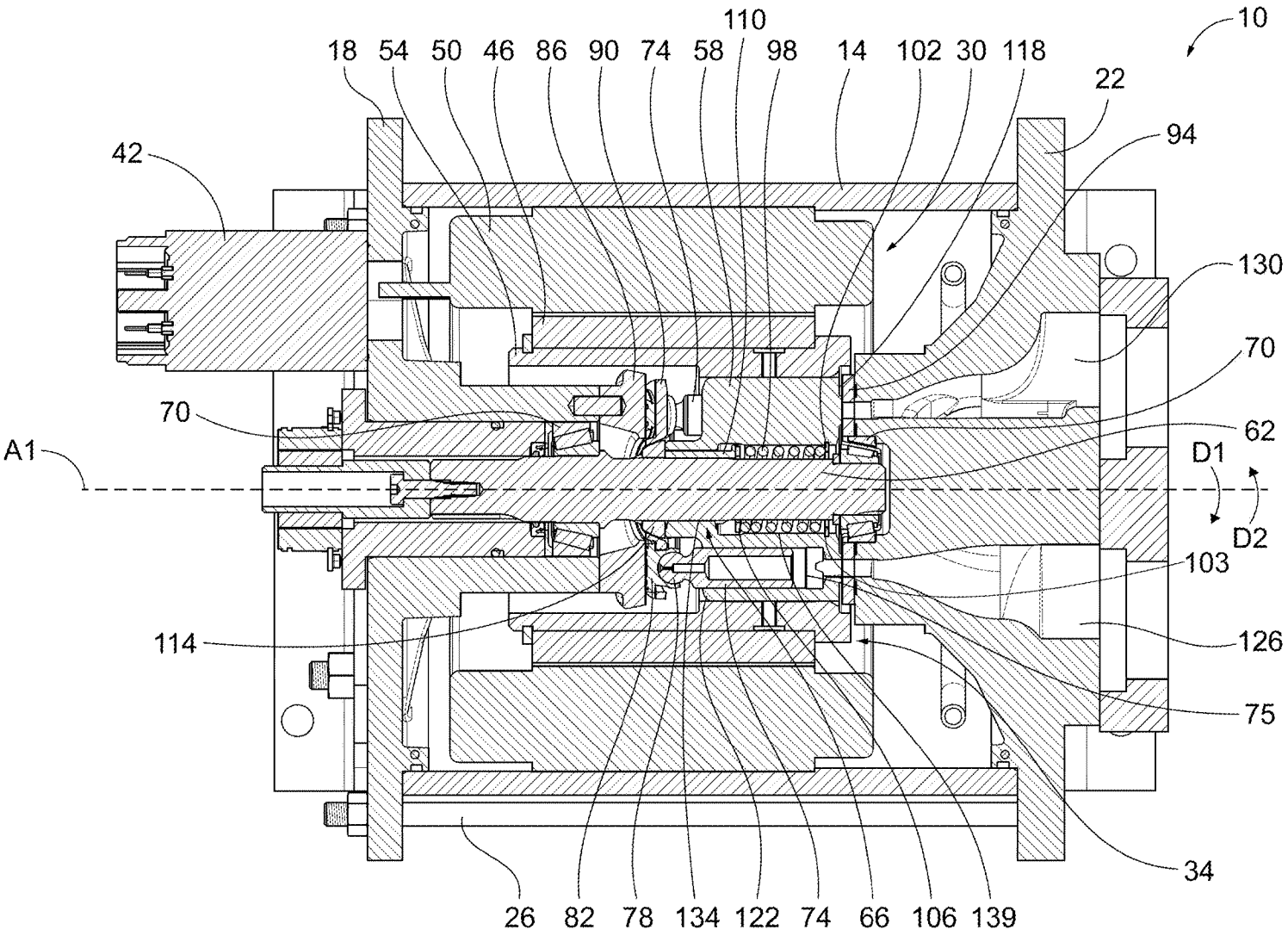
FIG. 3 illustrates a longitudinal cross-section of the integrated electro-hydraulic unit taken along line 3-3 of FIG. 1.

FIGS. 2 and 3 illustrate how the hydraulic machine 34 is nested within the electric machine 30 such that the electric machine 30 encircles the hydraulic machine 34. The electric machine 30 can be a motor of any suitable topology including, but not limited to, induction, surface permanent magnet, internal permanent magnet, wound rotor, and switched reluctance. The hydraulic machine 34 can be an axial piston machine of swashplate type (as illustrated) or a bent axis pump, which operates on the same principles but lacks a movable swashplate.

The electric machine 30 includes a rotor 46 and a stator 50 with a winding. The stator 50 is located most proximal to the radial casing 14. The rotor 46 is located radially inward toward the axis A1 from the stator 50. Both the rotor 46 and the stator 50 encircle the hydraulic machine 34. The rotor 46 is coupled to a drive flange 54, which is a component of the hydraulic machine 34. The drive flange 54 is radially disposed from the axis A1 between the electric machine 30 and a cylinder block 58. The drive flange 54 is configured to define an interface between the electric machine 30 and the cylinder block 58 such that power from the electric machine 30 is transferred to the cylinder block 58 and vice versa. The axial spans of the rotor 46 and the cylinder block 58 are mismatched in size and/or position (e.g., the axial span of the rotor 46 is greater than the axial span of the cylinder block 58). As such, the drive flange 54 is provided as a radially interposed adapter, configured to transmit rotation between the rotor 46 and the cylinder block 58.

Figure 5:
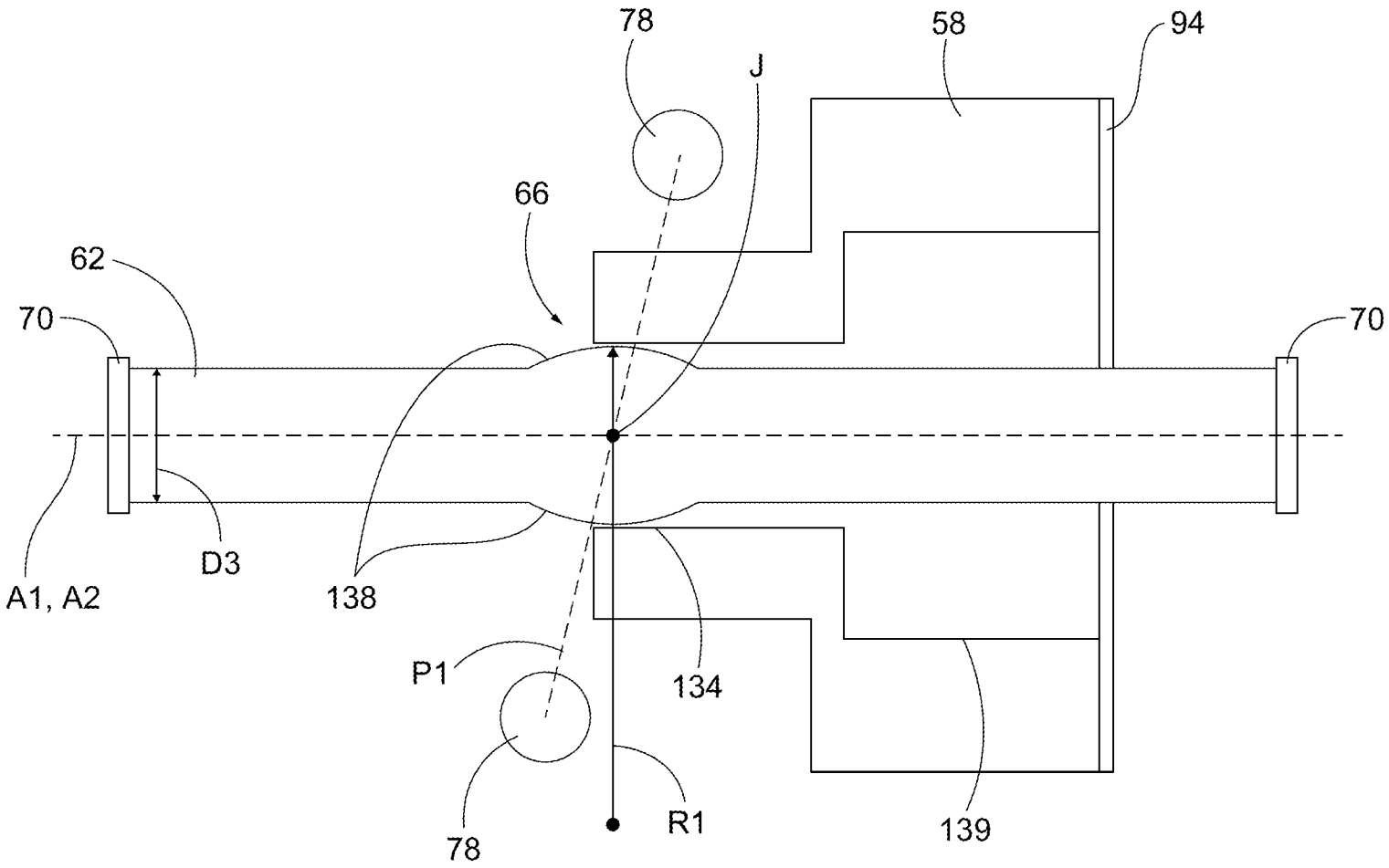
FIG. 5 schematically illustrates a cross-section of a joint of the integrated electro-hydraulic unit of FIG. 1.

The hydraulic machine 34 includes a shaft 62 that passes through the cylinder block 58. The shaft 62 includes a monolithic construction. The monolithic construction of the shaft 62 includes a splined portion in some constructions. The cylinder block 58 and the shaft 62 are coupled for rotation via a joint 66 along the axis A1 (see FIG. 5). The joint 66, which accommodates some deflection of the shaft 62 with respect to the cylinder block 58, is discussed in further detail below. The shaft 62 is rotatably supported by bearings 70 within the end cases 18, 22. The bearings 70 are preloaded by the shaft 62. The hydraulic machine 34 further includes a plurality of pistons 74 that are received within a plurality of bores 75. The plurality of bores 75 are formed in the cylinder block 58 circumferentially around the axis A1. The plurality of pistons 74 include ball ends 78 that are received by a plurality of slippers 82 that are moveable on a swashplate 86 about the axis A1. The swashplate 86 cooperates with the plurality of pistons 74 to generate reciprocating movement of plurality of pistons 74 within the plurality of bores 75 upon rotation of the cylinder block 58 about the axis A1. The plurality of slippers 82 are supported by a retaining plate 90 that is parallel to the swashplate 86. The hydraulic machine 34 includes a valve plate 94 axially disposed between the cylinder block 58 and the porting end case 22. The valve plate 94 is coupled to the porting end case 22. The cylinder block 58 is axially biased by a biasing member 98 (e.g., a spring) toward the valve plate 94 such that an axial end face of the cylinder block 58 and an axial end face of the valve plate 94 oppose one another (i.e., a facing relationship). Since there is no structure between the respective axial end faces of the cylinder block 58 and the valve plate 94, they are directly against one another—either in direct contact or only separated by a hydrodynamic layer during operation. An axis A2 of the cylinder block 58 is parallel with the axis A1 (FIG. 5). The cylinder block 58 includes an axial degree of freedom because it is capable of being biased along the axis A1 via the spring 98. The cylinder block 58 includes a first abutment feature 102 and a second abutment feature 106. The spring 98 interacts with the first abutment feature 102 and the second abutment feature 106. The first abutment feature 102 is formed in the shape of a ring and is received within a groove 103 of the cylinder block 58. The first abutment feature 102 is biased via the spring 98 toward the valve plate 94. The second abutment feature 106 is formed in the shape of a ring and is supported by a plurality of pins 110. The plurality of pins 110 extend through the joint 66 and contact a retainer 114 (FIG. 3). In the illustrated embodiment, the plurality of pins 110 includes a total of three pins equally distributed about the axis A1. The retainer 114 also includes an axial degree of freedom along the axis A1. The spring 98 biases the retainer 114 via the pins 110 toward the swashplate end case 18. The retainer 114 contacts the retaining plate 90 such that the retaining plate 90 is biased toward the swashplate 86 to ensure that the slippers 82 remain in contact with the swashplate 86. Therefore, the spring 98 ensures that the cylinder block 58 and the valve plate 94 remain directly against each other and that that the slippers 82 remain in contact with the swashplate 86 via biasing the abutment features 102, 106, respectively.

The cylinder block 58 is rotatable about the axis A1 in a first rotational direction D1 and a second rotational direction D2, enabling the integrated electro-hydraulic unit 10 to pump a working fluid. For reference, the first rotational direction D1 is considered clockwise rotation of the cylinder block 58 if viewing the integrated electro-hydraulic unit 10 along the axis A1 with the swashplate end case 18 proximal. In addition to pumping, the integrated electro-hydraulic unit 10 can also transfer the fluid power into mechanical power. In other words, the hydraulic machine 34, or "pump," has the capability of pumping, but also the capability of motoring. The capability of switching between pumping and motoring is possible by reversing a rotational direction of the electric machine 30. A unit capable of pumping and motoring is commonly referred to as a two-quadrant unit in the art.

As the cylinder block 58 rotates in either the first or second rotational direction D1, D2, each of the plurality of pistons 74 move in a reciprocating movement within the plurality of bores 75 from a first end 118 of the cylinder block 58, known as a top dead center, toward a second end 122 of the cylinder block 58, known as the bottom dead center. As each of the plurality of pistons 74 moves away from the top dead center and toward the bottom dead center, fluid is pulled through a suction port and the valve plate 94 and into the cylinder block 58. As each of the plurality of pistons 74 moves away from the bottom dead center and toward the top dead center, fluid is pushed out of the cylinder block 58 and through the valve plate 94 and a delivery port. In other words, the valve plate 94 is configured to direct flow into and out of the plurality of bores 75 in the cylinder block 58. In the first rotational direction D1, fluid is pulled through a first port 126 (i.e., the suction port) and expelled through a second port 130 (i.e., the delivery port). In the second rotational direction D2 fluid is pulled through the second port 130 (i.e., the suction port) and expelled through the first port 126 (i.e., the delivery port). Although the cylinder block 58 and the valve plate 94 are in facing relationship, the cylinder block 58 and the valve plate 94 do not contact one another during rotation of the cylinder block 58. Rather, a film of the working fluid forms an axial gap between the cylinder block 58 and the valve plate 94. The axial gap between the cylinder block 58 and the valve plate 94 is only a few microns. Additionally, it is worth noting that although there is the axial gap between the cylinder block 58 and the valve plate 94, openings in the cylinder block 58, the valve plate 94, and the ports 126, 130 remain substantially aligned so that the working fluid may flow unobstructed in and out of the cylinder block 58.

A difference in pressure exists between pistons of the plurality of pistons 74 that expel fluid to the delivery port and pistons of the plurality of pistons 74 that pull fluid from the suction port. Specifically, the pistons of the plurality of pistons 74 that expel fluid to the delivery port experience higher pressures than the pistons of the plurality of pistons 74 that pull fluid from the suction port. As a result of the higher pressure, a net force exists parallel to the axis A1 along the plurality of pistons 74. Since the plurality of pistons 74 are spaced away from the axis A2 of the cylinder block 58, the net force of the plurality of pistons 74 results in a moment force acting on the cylinder block 58. The shaft 62 experiences the force because the shaft 62 is coupled to the cylinder block 58 at the joint 66 and therefore may deflect relative to the axis A1 between the bearings 70 as exaggerated in FIG. 6. The shaft 62 may deflect in a "U" shape such that the joint 66 is located at a perpendicular distance V from the axis A1. The distance V is substantially exaggerated in FIG. 6, however in the illustrated construction, the distance V will not exceed 50 microns. Since the joint 66 is not located directly between the bearings 70, the joint 66 experiences bending. The joint 66 ensures that the shaft 62 is unable to transfer bending loads to the cylinder block 58. In other words, the cylinder block 58 includes a degree of freedom in the direction perpendicular to the axis A1 such that that the cylinder block 58 may deflect in the perpendicular direction but maintain the facing relationship (i.e., remaining flat against the valve plate 94). The joint 66 accommodates bending of the shaft 62 while maintaining a parallel orientation of the axis A2 of the cylinder block 58 to the central axis A1.

Figure 4:
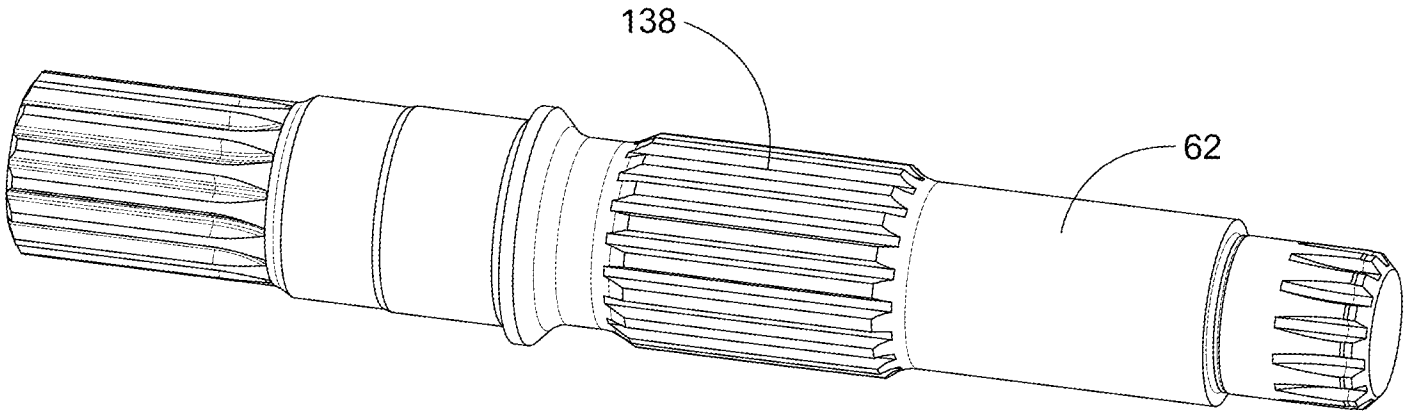
FIG. 4 illustrates a perspective view of a shaft of the integrated electro-hydraulic unit of FIG. 1.

The joint 66 couples the cylinder block 58 and the shaft 62 for rotation together. The joint 66 is defined between a corresponding receiving interior portion 134 of the cylinder block 58 and a barrel-shaped portion 138 (i.e., crowning shaft geometry) of the shaft 62. The joint 66 includes a splined interface (FIG. 4). The interior portion 134 and the barrel-shaped portion 138 have a splined interface in the illustrated construction. The interior portion 134 of the cylinder block 58 is defined by a locally-decreased diameter section of a central aperture 139 of the cylinder block 58. The interior portion 134 of the cylinder block 58 includes one or more surfaces parallel to the axis A1.

In FIG. 5, the shaft 62 is shown to include the barrel-shaped portion 138 having an exaggerated amount of rounding or curvature. The barrel-shaped portion 138 of the shaft 62 is formed by rounding about a constant radius R1 centered outside the shaft 62 as viewed transverse to the central axis A1. The rounding is performed along the axial direction parallel to the central axis A1. The radius R1 is not shown to scale in FIGS. 4 and 5 and can be 2000 millimeters or more. The radius R1 is 3000 millimeters in some constructions. For reference, the radius R1 of 3000 millimeters of the barrel-shaped portion 138 may be used in conjunction with the shaft 62 having a diameter D3 of 25 millimeters at the bearings 70. In other words, the radius R1 to the diameter D3 of the shaft 62 has a ratio of 120:1. In other constructions, the ratio of the radius R1 to the diameter D3 of the shaft 62 is in the range between 100:1 to 140:1. In other constructions, the ratio of the radius R1 to the diameter D3 of the shaft 62 is in the range between 110:1 to 130:1. In other constructions, the radius R1 may be increased or decreased to accommodate a larger or smaller deflection. In other constructions the size of the radius R1 may be scaled based on the diameter D3 of the shaft 62. The joint 66 includes a center point J located at an intersection point of the axis A1 and a piston plane P1. The piston plane P1 is defined as a plane in which the plurality of ball ends 78 rotate about the swashplate 86. The piston plane P1 is parallel to a swashplate plane P2 defined by the swashplate 86 (FIG. 2).

Figure 6:
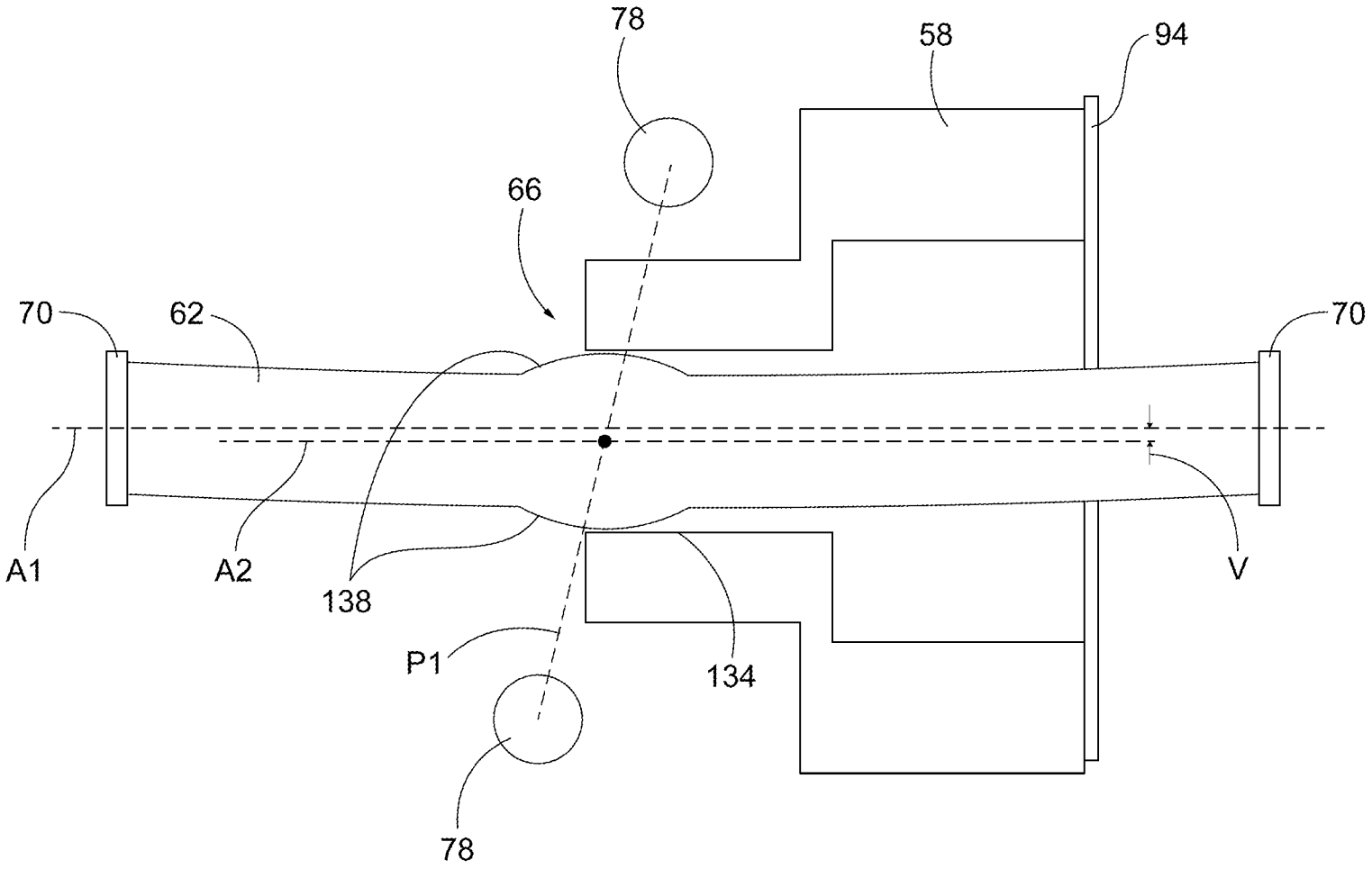
FIG. 6 schematically illustrates the cross-section of the joint accommodating a deflection of a shaft of the integrated electro-hydraulic unit of FIG. 1.

As exaggerated in FIG. 6, the joint 66 accommodates the shaft 62 bending via the barrel-shaped portion 138 interacting with the interior portion 134 of the cylinder block 58. As mentioned above, the joint 66 deflects by a perpendicular distance V relative to the axis A1 as illustrated in FIG. 6. The bending force of the shaft 62 is not transferred to the cylinder block 58 because the barrel-shaped portion 138 maintains contact with the interior portion 134 of the cylinder block 58 as shown in FIG. 6, without forcing the axis A2 of the cylinder block 58 to deflect from the axis A1. As such, the axis A2 of the cylinder block 58 remains parallel to the axis A1. Additionally, it is worth noting that although the cylinder block 58 does deflect by the vertical distance V, openings in the cylinder block 58, the valve plate 94, and the ports 126, 130 remain substantially aligned so that the working fluid may flow unobstructed in and out of the cylinder block 58.

All electric machines have magnetic pulling forces (i.e., radial forces) caused by an axial offset between a rotor and a stator. The axial offset can be created during assembly and manufacturing of an integrated electro-hydraulic unit. The axial offset between the rotor and the stator may also be induced by deflection of a shaft. The rotor 46 of the electric machine 30 has an axial span measured along the central axis A1. The axial span of the rotor 46 is bisected by a plane that is oriented perpendicular to the central axis A1. The plane defines an axial center of the rotor 46. The stator 50 includes an axial span measured along the central axis A1. The stator 50 is bisected by a plane that is oriented perpendicular to the central axis A1. The plane defines an axial center of the stator 50. The axial center of the rotor 46 is axially aligned along the axis A1 with the axial center of the stator 50 in some constructions. The joint 66 is axially centered on the axial center of the rotor 46 along the axis. The center point J of the joint 66 is axially aligned with the axial center of the rotor 46 along the axis A1 such that the magnetic pulling forces caused by the axial offset of the rotor 46 and the stator 50 are equal and opposite on each axial side of the center point J along the axis A1. As such, the magnetic pulling forces between the rotor 46 and the stator 50 are balanced. The center point J of the joint 66 is axially aligned with the axial center of the rotor 46 and the axial center of the stator 50 along the axis A1 in some constructions. The center point J of the joint 66 is axially aligned with the axial center of the stator 50 along the axis A1 in some constructions.

What is claimed is:

1. An integrated electro-hydraulic unit comprising:

an electric machine including a stator and a rotor; and a hydraulic machine including a shaft configured to rotate around a central axis and a cylinder block coupled to the shaft, the cylinder block having a plurality of bores receiving a plurality of pistons, wherein the cylinder block is configured to rotate about the central axis to generate reciprocating movement of the plurality of pistons within the plurality of bores, wherein the cylinder block and the shaft are coupled for rotation via a joint that accommodates bending of the shaft while maintaining a parallel orientation of the cylinder block with respect to the central axis, and wherein the joint is defined by a portion having a crowning shaft geometry of the shaft and a corresponding interior receiving portion of the cylinder block, wherein the portion having the crowning shaft geometry is formed by rounding about a constant radius centered outside the shaft as viewed transverse to the central axis.

2. The integrated electro-hydraulic unit of claim 1, wherein the interior receiving portion is defined by a locally-decreased diameter section of a central aperture of the cylinder block.

3. The integrated electro-hydraulic unit of claim 2, wherein the interior receiving portion of the cylinder block is formed by one or more surfaces extending parallel to the central axis.

4. The integrated electro-hydraulic unit of claim 1, wherein the joint includes a splined interface.

5. The integrated electro-hydraulic unit of claim 1, further comprising a valve plate configured to direct flow into and out of the plurality of bores in the cylinder block, wherein the cylinder block and the valve plate are flat against each other, and wherein the cylinder block is axially biased toward the valve plate via a biasing member.

6. The integrated electro-hydraulic unit of claim 1, wherein the shaft includes a diameter, and wherein a ratio of the radius of the portion having the crowning shaft geometry to the diameter of the shaft is in the range of 100:1 to 140:1.

7. The integrated electro-hydraulic unit of claim 1, wherein the shaft includes a monolithic construction.

8. The integrated electro-hydraulic unit of claim 1, wherein the joint is axially centered on an axial center of the rotor.

9. An integrated electro-hydraulic unit comprising:

an electric machine including a stator and a rotor; and a hydraulic machine including a shaft configured to rotate around a central axis and a cylinder block coupled to the shaft, the cylinder block having a plurality of bores receiving a plurality of pistons, wherein a swashplate cooperates with the plurality of pistons to generate reciprocating movement of the plurality of pistons within the plurality of bores upon rotation of the cylinder block, wherein the cylinder block and the shaft are coupled via a joint that accommodates bending of the shaft while maintaining a parallel orientation of the cylinder block with respect to the central axis, wherein the plurality of pistons include ball ends movable about the central axis and along the swashplate to define a piston plane parallel to the swashplate, wherein an axial center point of the joint is located at an intersection of the piston plane and the central axis.

10. The integrated electro-hydraulic unit of claim 9, wherein a center point of the joint is axially aligned with an axial center of the rotor.

11. The integrated electro-hydraulic unit of claim 9, wherein the joint is defined by a barrel-shaped portion of the shaft and a corresponding interior receiving portion defined by a locally-decreased diameter section of a central aperture of the cylinder block.

12. The integrated electro-hydraulic unit of claim 11, wherein the barrel-shaped portion is formed by rounding about a constant radius centered outside the shaft as viewed transverse to the central axis, and wherein the shaft includes a diameter, wherein a ratio of the radius of the barrel-shaped portion to the diameter of the shaft is in the range of 110:1 to 130:1.

13. The integrated electro-hydraulic unit of claim 9, further comprising a valve plate, wherein the cylinder block is axially biased toward the valve plate via a biasing member.

14. The integrated electro-hydraulic unit of claim 13, further comprising a first abutment feature, wherein the cylinder block includes a groove, and wherein the first abutment feature is received within the groove and is biased via the biasing member.

15. An integrated electro-hydraulic unit comprising:

an electric machine including a stator and a rotor, the rotor including an axial center; and a hydraulic machine including a shaft configured to rotate around a central axis and a cylinder block coupled to the shaft, the cylinder block having a plurality of pistons within the cylinder block, the cylinder block configured to rotate about the central axis to generate reciprocating movement of each of the plurality of pistons, wherein the cylinder block and the shaft are coupled via a joint that accommodates bending of the shaft while maintaining a parallel orientation of the cylinder block with respect to the central axis, wherein the joint is defined by a portion having a crowning shaft geometry of the shaft and a corresponding interior receiving portion of the cylinder block, wherein a center point of the joint is axially aligned with the axial center of the rotor, wherein the portion having the crowning shaft geometry is formed by rounding about a constant radius centered outside the shaft as viewed transverse to the central axis.

16. The integrated electro-hydraulic unit of claim 15, wherein the interior receiving portion is defined by a locally-decreased diameter section of a central aperture of the cylinder block, the interior receiving portion of the cylinder block is formed by one or more surfaces extending parallel to the central axis, and the interior receiving portion of the cylinder block is configured to engage a splined portion of the shaft.

17. The integrated electro-hydraulic unit of claim 15, wherein the center point of the joint is axially aligned with an axial center of the stator.

18. The integrated electro-hydraulic unit of claim 15, further comprising a valve plate;

a biasing member; and a first abutment feature, wherein the cylinder block includes a groove, wherein the first abutment feature is received within the groove and is biased via the biasing member such that the cylinder block is axially biased toward the valve plate via the biasing member, and wherein the cylinder block and the valve plate are flat against each other.

19. The integrated electro-hydraulic unit of claim 15, wherein the shaft includes a monolithic construction including a splined portion.

* * * * *